US007996948B2

(12) United States Patent
Kaminer et al.

(10) Patent No.: US 7,996,948 B2
(45) Date of Patent: Aug. 16, 2011

(54) QUILTED FABRIC TOWEL STEAM POCKET FOR A STEAM APPLIANCE

(75) Inventors: Brian Kaminer, Harrison, NY (US); Charles A. Boulos, Milford, MA (US); James N. Lewiecki, Essex, MA (US); Kathleen V. Jones, Somerville, MA (US); Ognjen Vrdoljak, Laval (CA)

(73) Assignee: Euro-Pro Operating LLC, Newton, MA (US)

( * ) Notice: Subject to any disclaimer, the term of this patent is extended or adjusted under 35 U.S.C. 154(b) by 0 days.

(21) Appl. No.: 12/467,057

(22) Filed: May 15, 2009

(65) Prior Publication Data

US 2010/0272948 A1 Oct. 28, 2010

Related U.S. Application Data

(60) Provisional application No. 61/172,523, filed on Apr. 24, 2009.

(51) Int. Cl.
*A47L 13/10* (2006.01)

(52) U.S. Cl. ..... 15/209.1; 15/228

(58) Field of Classification Search ..... 15/403, 15/208, 209.1, 119.1, 119.2, 118, 223, 228, 15/229.3, 322

See application file for complete search history.

(56) References Cited

U.S. PATENT DOCUMENTS

| | | | | |
|---|---|---|---|---|
| 4,114,223 | A * | 9/1978 | Buchanan | 15/228 |
| 5,715,561 | A | 2/1998 | Tuthill et al. | |
| 6,389,637 | B1 * | 5/2002 | Hurell | 15/247 |
| 7,600,401 | B2 * | 10/2009 | Rosenzweig | 68/5 R |
| 2005/0283934 | A1 | 12/2005 | Amatucci | |
| 2006/0000049 | A1 | 1/2006 | Rosenzweig | |
| 2008/0066789 | A1 | 3/2008 | Rosenzweig et al. | |
| 2008/0168614 | A1 | 7/2008 | Guohua | |
| 2009/0320231 | A1 | 12/2009 | Rosenzweig et al. | |
| 2010/0269282 | A1 | 10/2010 | Kaminer et al. | |

FOREIGN PATENT DOCUMENTS

| | | |
|---|---|---|
| DE | 4427672 A1 | 2/1996 |
| DE | 29910658 U1 | 9/1999 |
| EP | 1704808 A | 9/2006 |

OTHER PUBLICATIONS

Invitation to Pay Additional Fees for PCT/US2009/044294 mailed Jan. 14, 2010.

International Search Report and Written Opinion for PCT/US2009/044295 mailed Apr. 6, 2010.

* cited by examiner

*Primary Examiner* — Dung Van Nguyen

(74) *Attorney, Agent, or Firm* — Wolf, Greenfield & Sacks, P.C.

(57) ABSTRACT

A fabric steam towel for mounting onto a steam frame of a steam appliance is provided. The pocket includes two complimentary substantially planar layers of fabric joined at their peripheral edge with an open section for mounting onto the steam frame and allowing the open edges to butt against each other. The fabrics are constructed of an outer terry layer and inner material with an upper jersey layer, padding and a lower mesh layer with a 45 degree quilting pattern to improve performance. The fabric is sealed about the frame a first length of a fastener is secured to the inside face along the open edge of one layer with a complimentary length of fastener secured to the inside face of the second layer and extending beyond the edge to allow the open edges of each layer to abut each other and for the fasteners to engage and secure the fabric pocket about the edge of the frame.

20 Claims, 12 Drawing Sheets

QUILTED FABRIC TOWEL STEAM POCKET FOR A STEAM APPLIANCE

CROSS-REFERENCE TO RELATED APPLICATIONS

This application is based on and claims the benefit of provisional application No. 61/172,523 filed Apr. 24, 2009.

BACKGROUND OF THE INVENTION

The invention relates generally to a fabric pocket for a steam appliance, and more particularly to a quilted fabric towel in the form of an envelope to form a steam pocket when installed on a steam frame of a steam appliance.

Steam cleaners and/or devices used to apply steam to household objects are well known. The uses of the devices vary widely, and may include the application of steam to drapes or other fabrics to ease wrinkles, and the application of steam to objects to assist in cleaning the objects. Steam cleaners also have been used for cleaning carpeted floors, but usually overly saturate the carpet and require long period of time to dry.

Typical steam devices have a reservoir for storing water that is connected to an electrical water pump with an on/off switch. The exit from the electric water pump is connected to a steam boiler with a heating element to heat the water. The heated water generates steam, which may be directed towards its intended destination through a nozzle which controls the application of the steam. Variation of the shape and size of the nozzle allows for preferred distribution of generated steam to an object to be cleaned. The nozzles may be disconnectable from the steam generator to allow different nozzles to be utilized, based on the object to be steamed. The nozzle may be either closely coupled to the steam generator, or located at a distance from the steam generator, requiring tubing or other steam transfer structures to be interconnected between the steam generator and the discharge nozzle. Typically, it is beneficial to provide suitable connectors between the steam generator and the nozzle to allow either the nozzle to be connected to the steam generator, or to allow the interpositioning of transfer tubes or hoses between the steam generator, and the nozzle.

In general, the nozzles used with the steam cleaners do not have large surface areas. A cloth or towel is placed on a steam frame coupled to the steam nozzle to distribute the steam.

Notwithstanding the wide variety of steam generating appliances and cleaning towels available, there exists the need to provide improved accessories for use with a steam cleaner.

SUMMARY OF THE INVENTION

Generally speaking, in accordance with the invention, a quilted fabric in the form of an envelope with one open edge for mounting onto a steam frame of a steam generating device to form a steam pocket is provided. The quilted fabric towel has improved steam distribution properties. The fabric layers of the steam pocket have a terry outer layer and an inner knit fabric lining material that includes a base mesh layer, a padding layer and a jersey layer facing the outer terry layer. The surface of the towel is diagonally quilted from the open edge at 45 degrees to the closed front in geometric pattern with quilt lines crossing at 90 degrees. A slot along the open back edge is provided to accommodate a connection to the appliance and allow for unlimited steering of the steam pocket and use of both sides of the towel for cleaning.

The fabric envelope is formed from two substantially planar layers of fabric configured to fit over a steam frame with fasteners to lock the pocket closed about the frame. The surface layers are joined around their perimeter along the sides and leaving an open edge for mounting onto the steam frame. A pair of fastening strips are secured to the inner side of one layer along the open edge and on the outer side of the other layer with one set of strips extending beyond the edge. When placed on the frame and secured the fabric edges of both layers are butting each other along a closure line. This locks the steam pocket closed to prevent the escape of steam out the open edge of the fabric envelope. In another embodiment, the fabric may include a pull ribbon for assisting installation on to the frame.

Accordingly, it is an object of the invention to provide an improved fabric steam towel to form a steam pocket in a steam appliance.

Another object of the invention is to provide a steam towel for a steam appliance with improved cleaning performance.

Yet another object of the invention is to prove a fabric towel with a closure to lock the pocket closed in the back of the steam frame for improved steaming.

A further object of the invention is to provide a steam towel for a steam appliance with improved push/pull performance.

Yet another object of the invention is to provide a steam towel for a steam appliance having improved durability.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
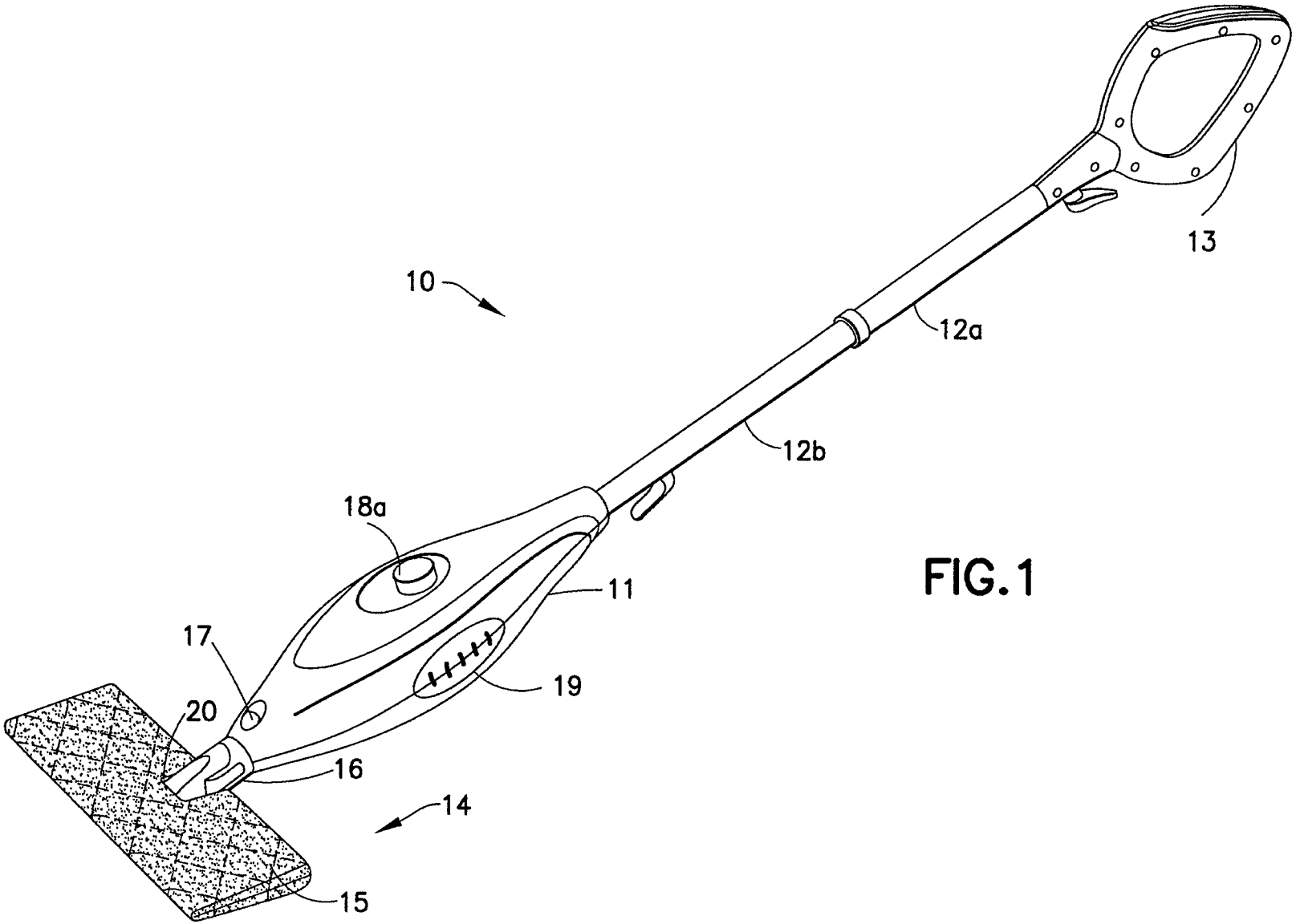
FIG. 1 is a perspective view of a steam mop including a steam pocket constructed and arranged in accordance with the invention.

FIG. 1 is a perspective view of a steam mop 10 constructed and arranged in accordance with the invention. Mop 10 includes an elongated housing 11 with a water reservoir 21 and a boiler 23 shown in FIG. 2 and an upper tube 12*a* and a lower tube 12*b* connected to one end of housing 11. A handle 13 is attached to the end of upper tube 12*a*. A steam frame 14 with a receiving slot 20 with an installed steam pocket 15 is operatively connected to the other end of housing 11 by a connector 16. In this embodiment, connector 16 and frame 14 may be removed from housing 11 by pressing a release button 17 at the base of housing 11. Water is introduced into a reservoir 21 at a water inlet or opening 18*a*. The level of water present in a reservoir 21 in housing 11 can be viewed through a sighting window 19. The specifics of fabric steam pocket 15 will be described below.

Figure 2:
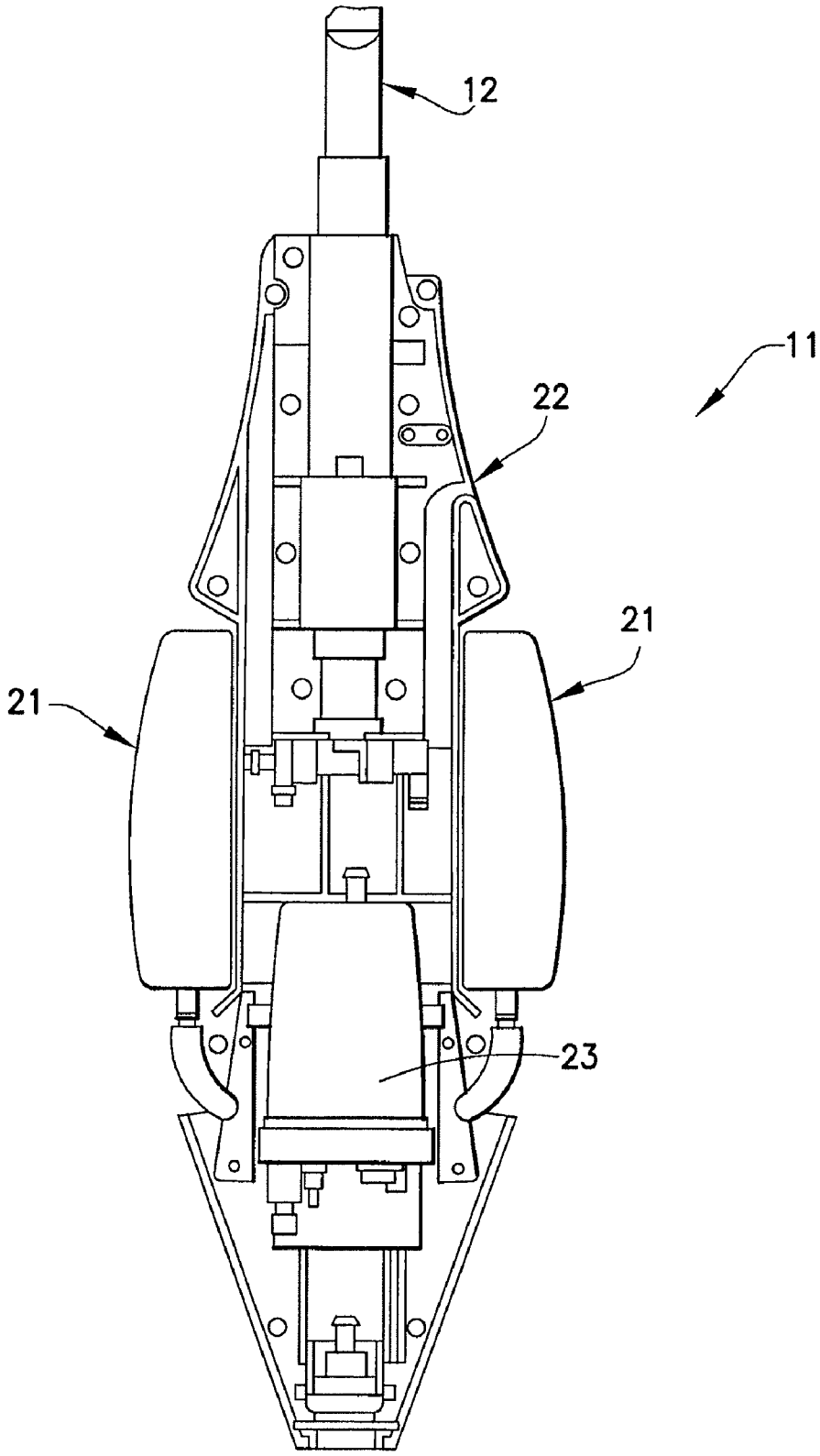
FIG. 2 is a front view of the mop housing in section showing a reservoir, a pump and a boiler in the mop of FIG. 1.

FIG. 2 is a front plan view in section showing the location of elements in housing 11. Water container 21 is positioned adjacent and surrounds boiler 23. A one-way pump 22 pumps water from reservoir 21 to boiler 23 in response to the push-pull movement of mop 10. This movement of handle 13 activates operation of pump 22 and one way inlet and outlet valves.

Figure 3:
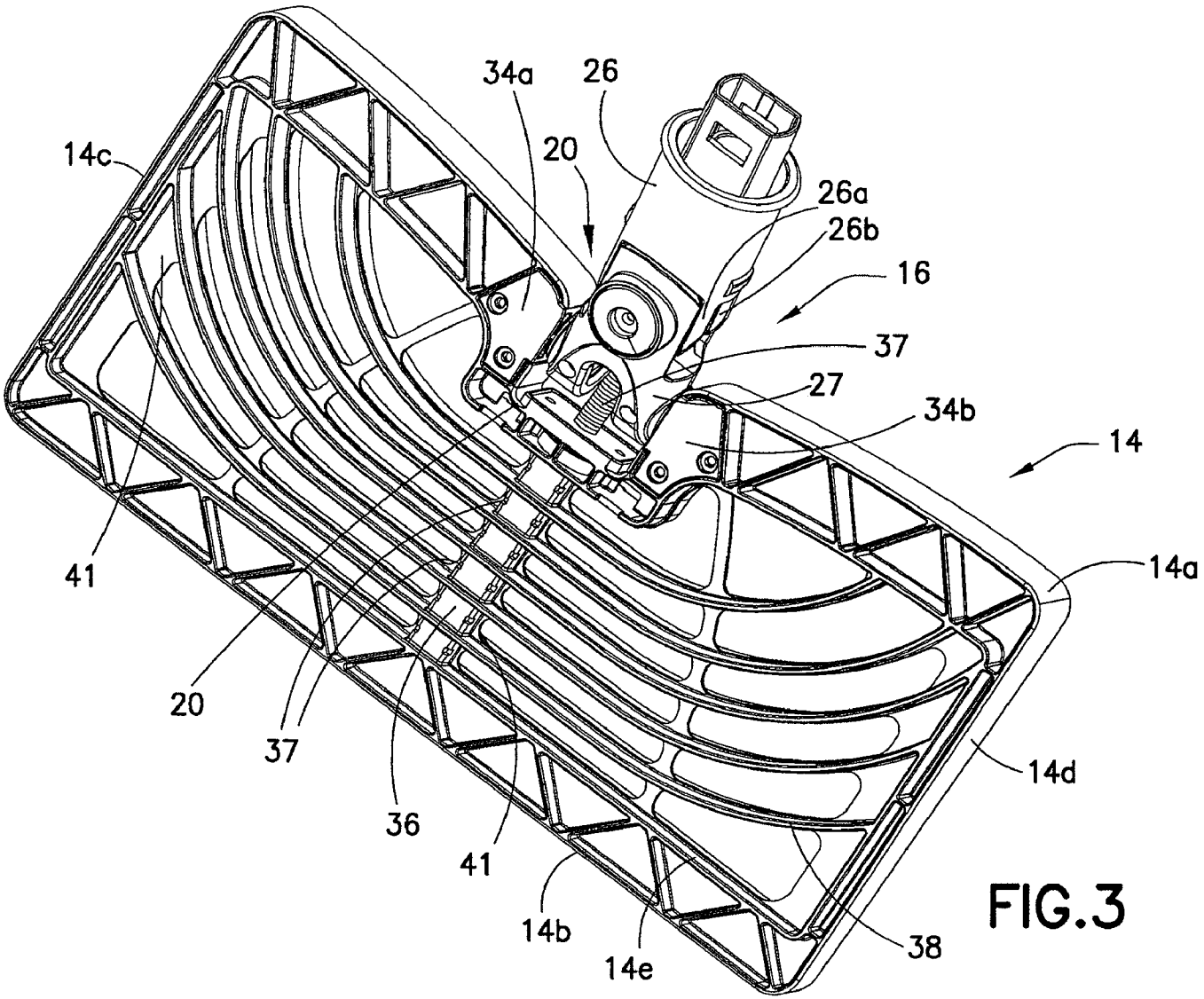
FIG. 3 is a perspective view of the steam mop frame and universal connector in the steam mop of FIG. 1.
Figure 4:
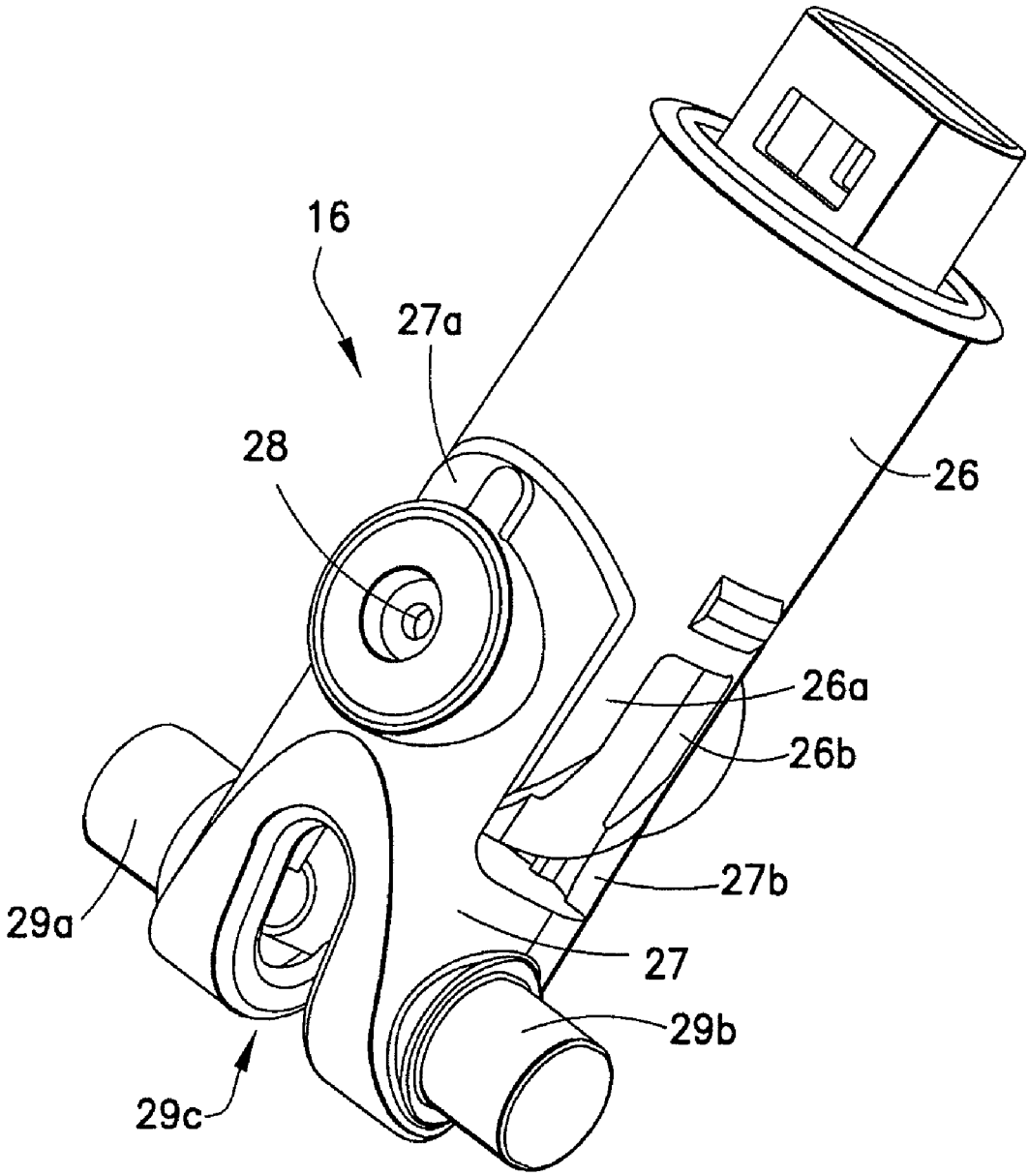
FIG. 4 is a perspective view of the universal connector for connecting the steam frame to the appliance housing as shown in FIG. 1.
Figure 5:
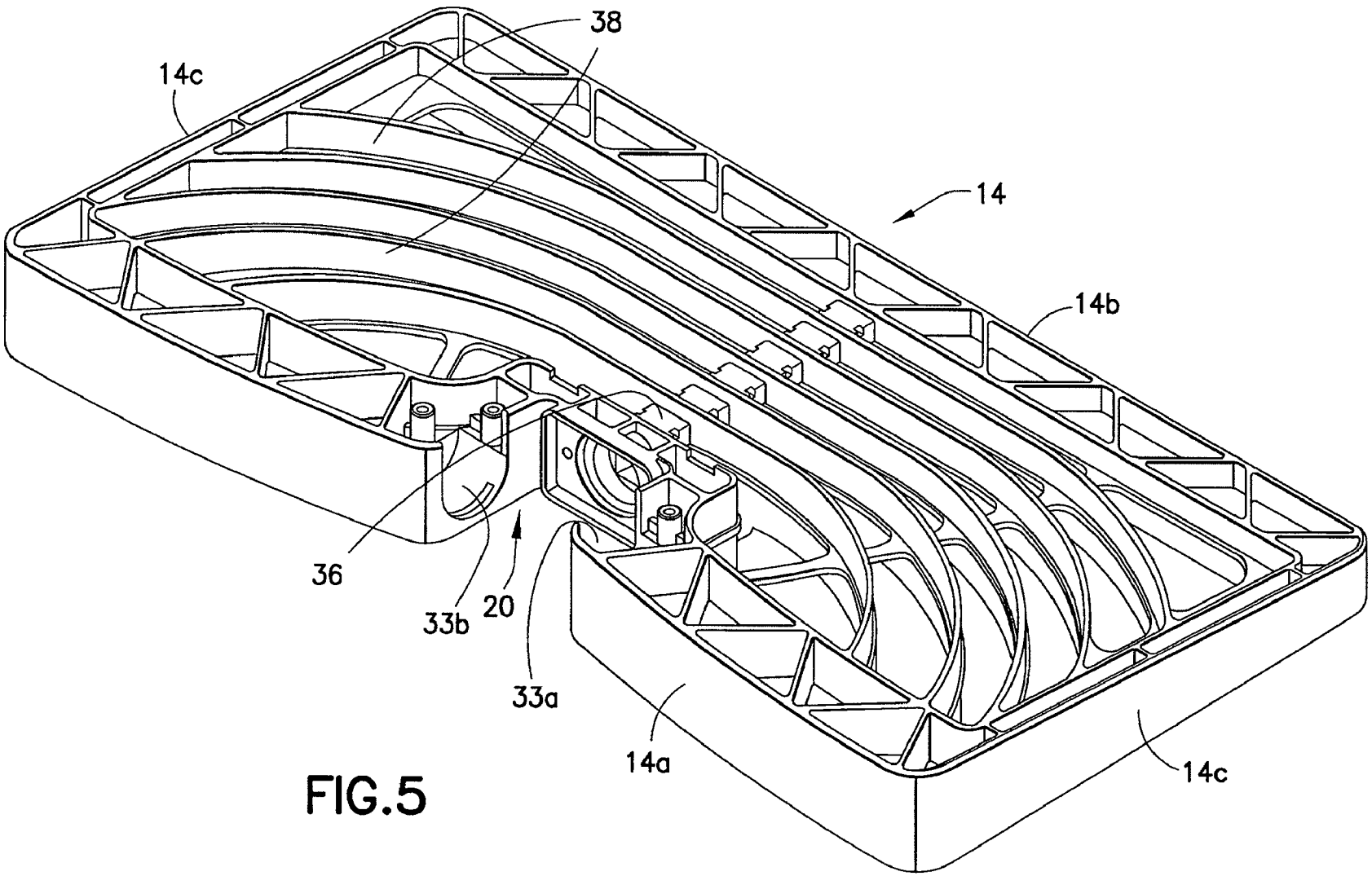
FIG. 5 is a rear perspective view of the steam frame showing the details of the steam frame of FIG. 3.

FIGS. 3-5 show the details of construction of universal connector 16 and steam frame 14 used with steam mop 10 of FIG. 1. Frame 14 is substantially rectangular in shape, open at the top and bottom with plurality of baffles as will be described in detail below.

Universal connector 16 includes and upper connection piece 26 with pivot plates 26*a* and 26*b* and a lower connection piece 27 with two pivot arms 27*a* and 27*b* coupled at a pivot pins 28 on upper piece 22 that allows steam frame 14 and housing 11 to pivot side to side.

Lower connection piece also includes two side arms 29*a* and 29*b* with a central opening 29*c* for passage of a flexible steam hose 32 to feed steam to frame 14. Frame 14 includes connector receiving slot bushings 33*a* and 33*b* for receiving side arms 29*a* and 29*b*. Two mounting plates 34*a* and 34*b* secure arms 29*a* and 29*b* in place to allow for up and down pivoting of arms 29*a* and 29*b*. This configuration allows for both sides of frame 14 and steam towel 15 to be used for steaming a surface to cleaned and for unlimited steering of the steam pocket during use.

As shown in FIGS. 3 and 5 steam frame 14 includes a rear wall 14*a* with connector receiving opening 20 in the center, a front wall 14*b* and a right side wall 14*c* and a left side wall 14*d*. A plurality of baffles 38 extend within the walls of frame 14. Frame 14 also includes a central steam passageway or manifold 36 that runs from the rear of frame 14 at a receiving slot 20 to a front border 14*e*. A plurality of steam release openings 37 are formed on both sides of manifold 36 along the top and bottom thereof. These release openings 37 are positioned between each baffle 38. Baffles 38 are substantially orthogonal to manifold 33 in the center of frame 14 and extend sideways and curve rearward to the side edges and rear wall of frame 14.

Steam hose 32 is connected to manifold 36 at a hose plate 39 mounted at the entrance to manifold 36. Short fins 41 extend from the sides of manifold 36 and edges 14*c* and 14*d* approximately at the mid-height of manifold 36 and side walls 14*c* and 14*d* to assist in distribution of steam to the upper and lower surfaces of steam towel 15 installed on frame 14 to form the steam pocket when in use.

Figure 7:
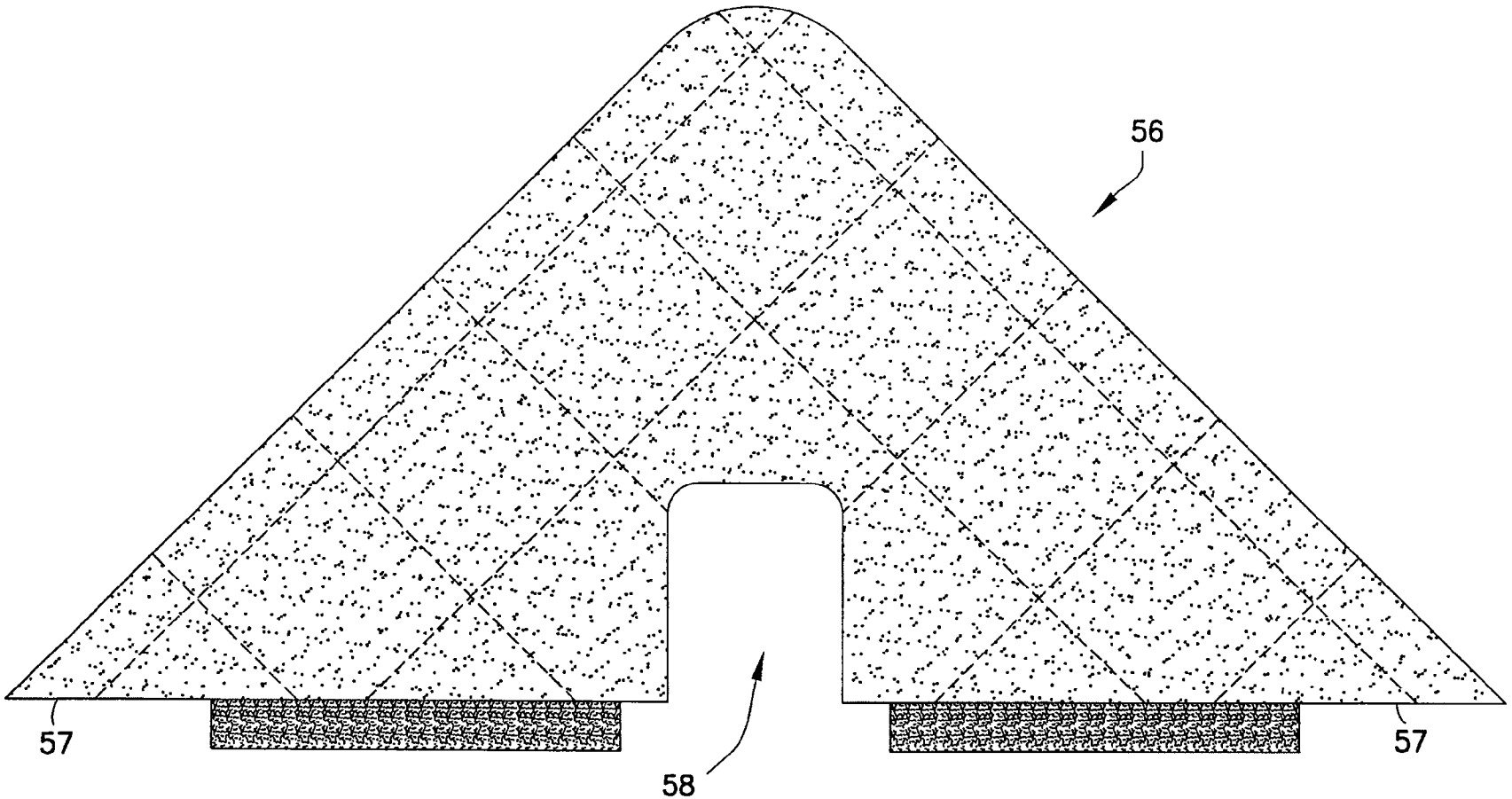
FIG. 7 is a plan view of a triangular quilted fabric steam towel in accordance with the invention that may be used with a triangular shaped steam frame and connector for the mop of FIG. 1.

Universal connector 16 provides many advantages for ease of use because it easily connect and disconnect to mop frame while providing a user with universal pivoting and steering capability. The user has more control of the appliance and frame by the universal connection to clean whatever areas that need to be clean and allows use of both sides of steam frame 14 for cleaning. In addition, the universal connector may be attached to any variety of differently shaped mop frames, such as rectangular frame 14 or a triangular frame shown in FIG. 7*a* for use with towel as shown in FIG. 7.

Figure 6:
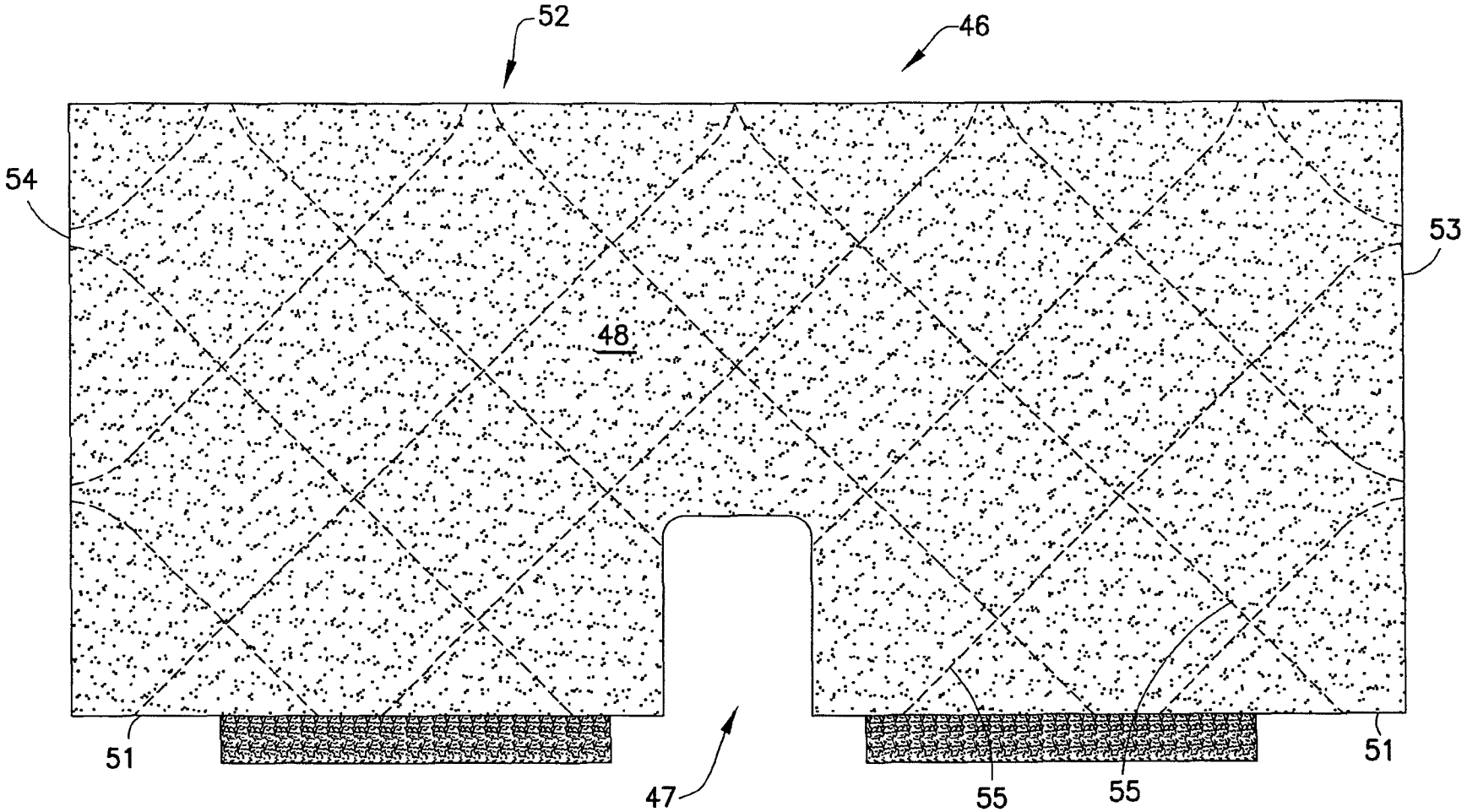
FIG. 6 is a plan view of a rectangular quilted fabric steam towel suitable constructed and arranged in accordance with the invention for use with the steam appliance of FIG. 1.
Figure 8:
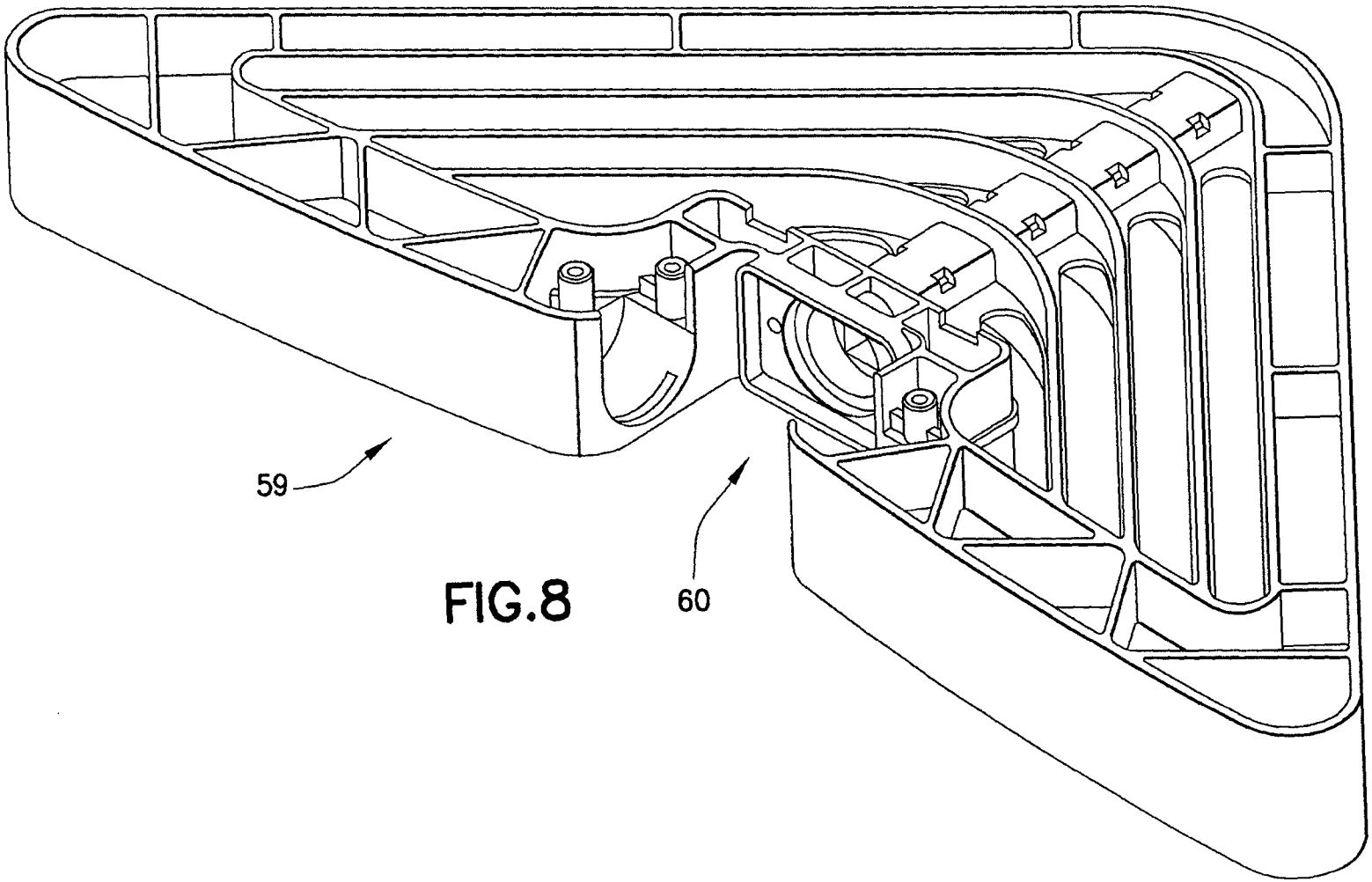
FIG. 8 is a rear perspective view of a triangular steam frame showing for use with the quilted fabric steam towel of FIG. 7.

FIG. 6 shows a rectangular towel envelope 46 with a "U" shaped slot 47 and is configured to slip over frame 14 to form a steam pocket 15. Steam towel 46 is formed of a first quilted fabric layer 48 and an opposed second quilted fabric 49. Quilted fabric 48 and 49 each have a substantially rectangular shape with a rear edge 51 in sections about slot 47, a front edge 52 and two short edges 53 and 54. The steam pocket formed by frame 14 and towel 46 is joined at edges 51, 52 and 53 by stitching in to form fabric steam towel 15. As shown in FIG. 7 a steam pocket fabric 56 may be triangular in shape or any shape with an open rear mounting edge 57 about a gap 58 for mounting over a steam frame 59 as shown in FIG. 8. Triangular frame 59 includes a slot 60 for receiving connector 16 as described in detail above in connection with frame 14.

Steam pocket fabric envelopes 15, 46 and 56 are open at rear edges 15*a*, 51 and 57. The fabric along the opening may be closed with a hook and loop fastener, buttons or snaps. Here, steam towels 15 and 46 have slots 20, 47 and 57 to fit around the width of connector 16. This allows for vertical rotation of housing 11 without bending the fabric of fabric steam towel 15. It also allows use of both sides of steam towel 15, 46 and 56 for cleaning without having to remove and re-install the steam towel 15.

As shown, the steam pocket fabrics are quilted in accordance with the invention. In the illustrated embodiments quilting stitches 55 extends from rear edges 15*a*, 51 and 57 at a 45 degree angle in two directions to the opposed fabric edges forming 2" squares. The size of the squares may vary from about 1" to about 3". It has been found that providing a quilted fabric surface improves cleaning performance of steam mop 11 when used on a variety of different stains. Quilting makes it easier to push and pull mop 11 compared to steam towels of terry material. In addition, steam towels including quilting in accordance with the invention are more durable after as many as twenty washing and drying cycles along with usage between each wash cycle.

Each fabric surface of the fabric towels are formed of two separate fabric layers. The outer layer is a woven terry of 100 percent polyester with a loop height of 3 mm of 0.72 denier yarn having a weight of 295 g/sq.m. The loops may vary from 2.5 to 3.5 mm with between 260 to 280 loops/sq. in. and the weight may vary from 280 to 310 g/sq.m.

The inner lining material has three components. These are an outer jersey layer facing the outer terry layer, padding and an inner mesh layer. The total weight of the lining materials is between 130 to 156 g/sq.m, preferably 140 g/sq.m. and between 0.065 to 0.085 inch in thickness, preferably 0.076 inch thick. The mesh has between 3 to 3.75 wales per inch and the jersey between 12 and 15 wales per inch with between 20 to 27 courses per inch, preferably 23 courses per inch.

Figure 9:
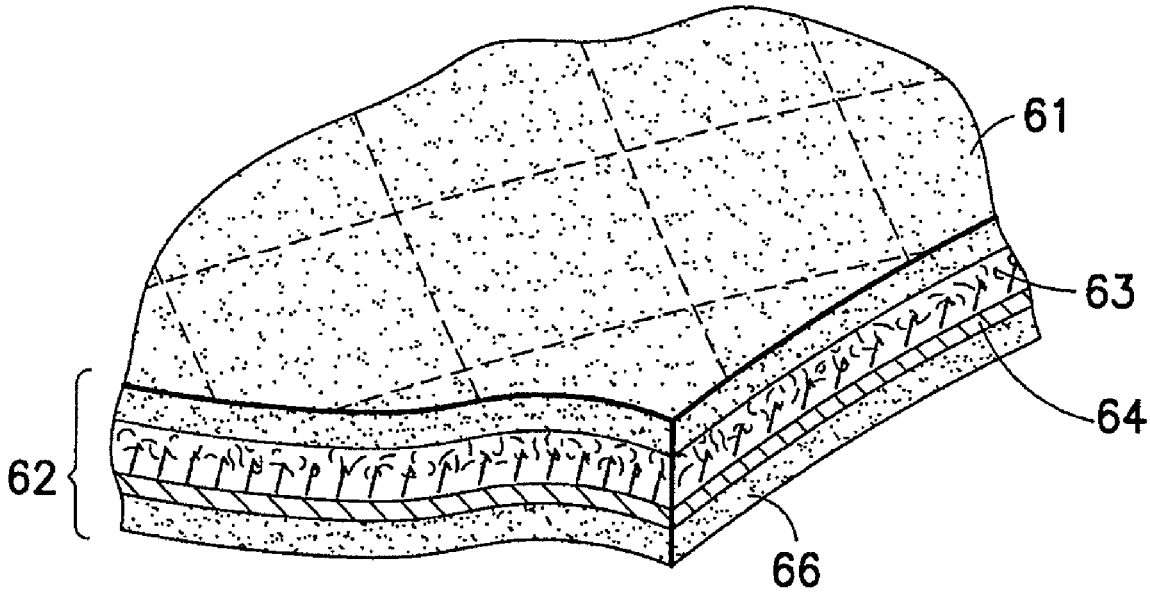
FIG. 9 is a schematic in section showing the terry and lining layers of the fabric towel in accordance with the invention.

The combined fabric layers have an overall thickness of between 0.15 to 0.17 inch, preferably 0.16 thick. The overall weight is between 435 to 485 g/sq.m., or preferably 460-461 g/sq.m. A schematic sectional showing of this fabric construction is set forth in FIG. 9. The fabric surfaces include an outside terry layer 61, and inner lining material 62 that includes a mesh layer 63 facing outside layer 61, a padding layer 64 and an inside jersey layer 66. All open edges of each surface of the steam towels are stitched along the rear edge and around slots 20, 47 and 58.

Figure 10A:
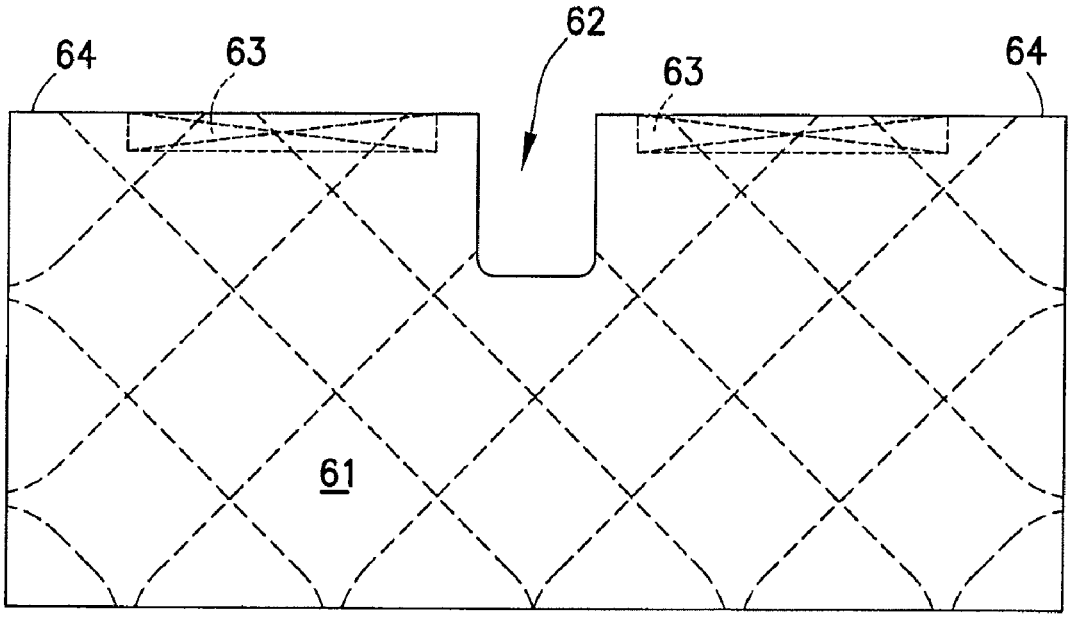
FIGS. 10*a* and 10*b* are schematics showing the position of hook and loop fasteners on the top and bottom layers of the steam towel in accordance with the invention.
Figure 10B:
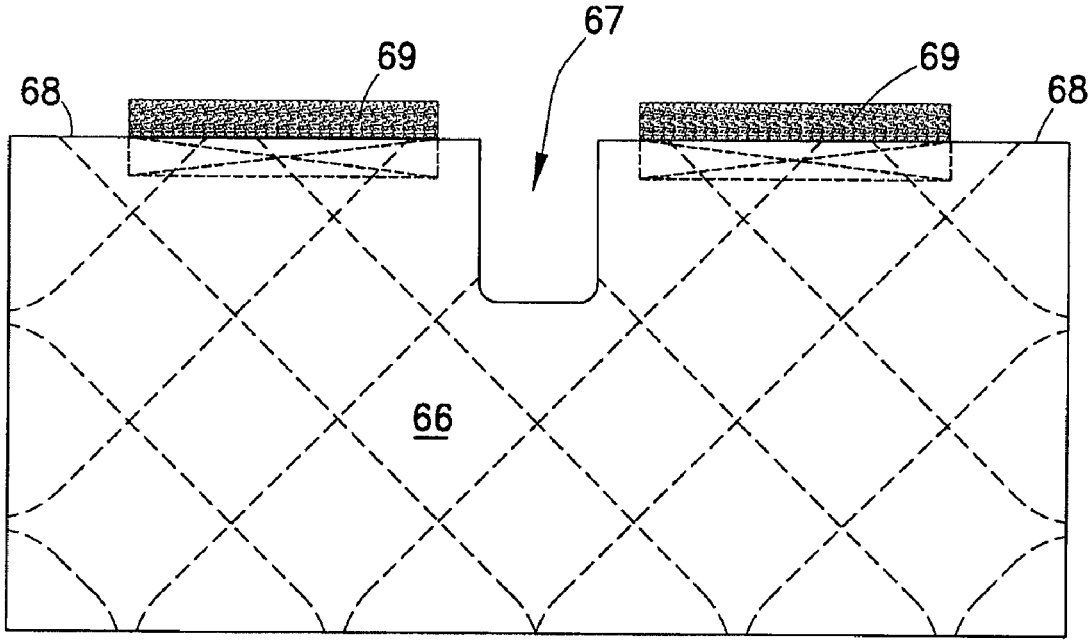

It is desirable to seal the open edge of the steam towels 60 when installed on a steam frame to lock the pocket closed and prevent steam escape as shown in schematic in FIGS. 9*a* and 9*b*. One quilted surface 61 includes a first length of a hook and loop fastener 63 secured to an inside open edge 64 on both sides of slot 62. Second quilted surface 66 with a complimentary slot 67 along open edge 68 in FIG. 9*b* includes a complimentary hook and loop fastener 69 is secured to the opposed inside edge and extending beyond edge 68*a*. This will allow edges 64 and 68 on each surface to abut and form a seal 71 along rear edge of frame 14 as shown in FIG. 10.

Fabric steam towels in accordance with the invention may be formed of any suitable fabric, such as cotton or a synthetic fabric, such as polyester or polyolefin fiber. Preferably, the fabric of steam towels is a microfiber. Most preferably, the microfiber is a synthetic 100% polyester microfiber. Typical dimensions for a rectangular steam pocket are about 13 inches wide and 7 inches deep and one inch thick. To close the open edge about 4 to 5 inches of fasteners are used on each side of the slots in the rear edges.

Figure 11:
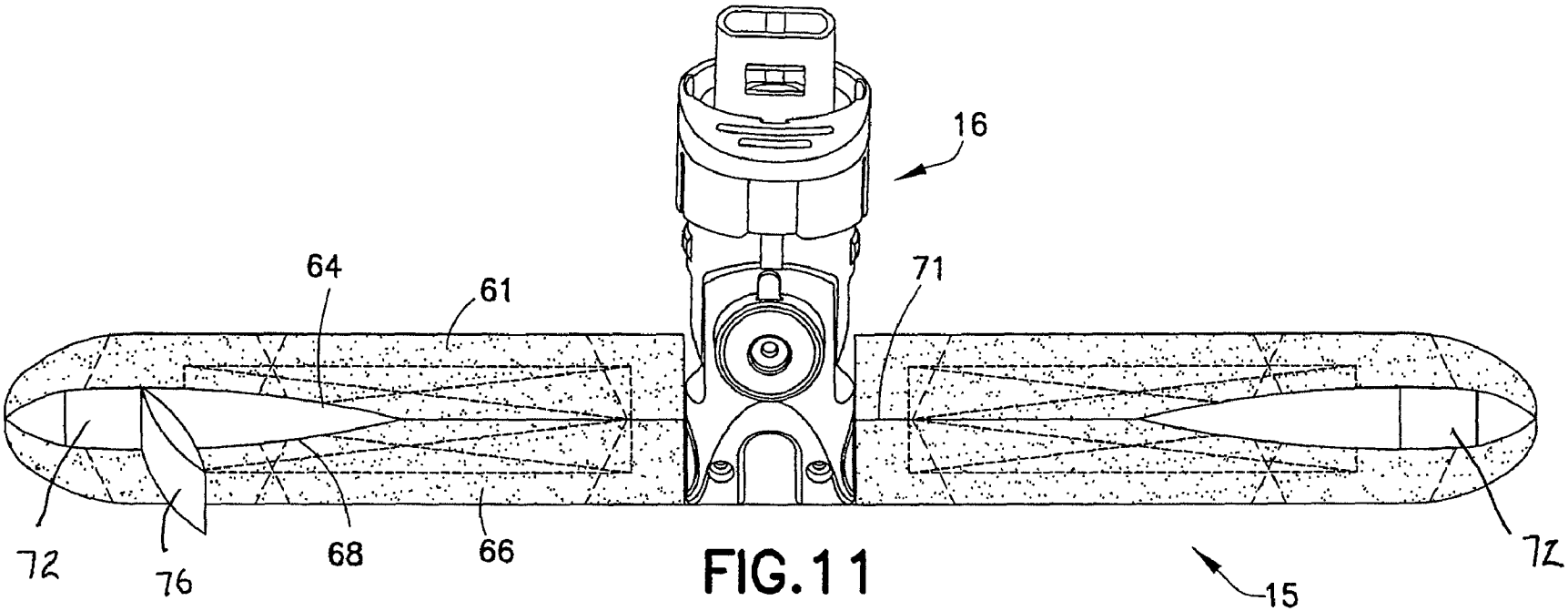
FIG. 11 is a rear elevation schematic view of the towel closure constructed and arranged in accordance with the invention.
Figure 12:
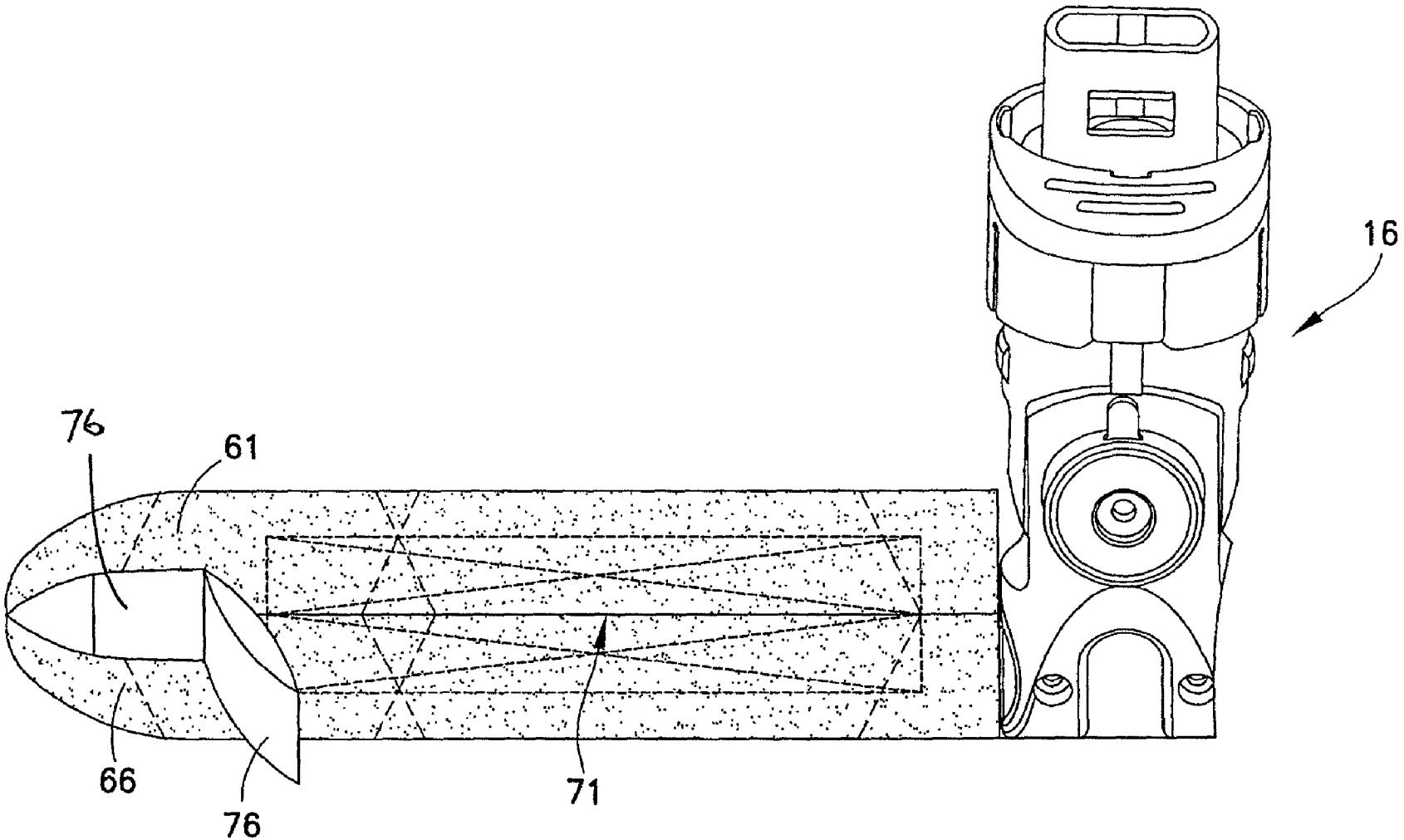
FIG. 12 is a partial rear elevational view of the installed steam towel with a pull ribbon on a steam frame in accordance with the invention.

When closure of edges 64 and 68 is complete and pocket 15 is sealed, the rear view is as shown in FIG. 11. Hook and loop fasteners 63 and 69 are not visible when installed. It is desirable to have fabric steam pocket 15 fit snugly about frame 14 for improved distribution of steam. In order to facilitate mounting fabric pocket 15 on frame 14, a pull ribbon 76 is attached to one side of edge opening with two strips of elastic 72 that allows a user to mount pocket 15 on one side of back edge of frame 14 and then pull on ribbon 76 to complete the installation of fabric pocket 15. Then hook and loop fasteners are secured to seal the envelope prior to use.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention.

What is claimed is:

1. A fabric steam pocket comprising:

two complementary substantially planar layers of steam-permeable fabric of the shape of a steam frame of a steam appliance, each layer of the steam-permeable fabric formed of an outer terry material, an inner mesh material and an intermediate terry material, and quilted with stitching on a fabric surface at a 45 degree angle, the layers of steam-permeable fabric being joined at their peripheral edges forming a substantially non-porous pocket with an open section for mounting onto the steam frame;

a first complementary fastener along an edge of the open section of one layer, the first complementary fastener being secured to an inside face of the one layer; and a second complementary fastener along an edge of the open section of the other layer, the second complementary fastener being secured to an inside face of the other layer and extending beyond the edge of the open section, the first and second complementary fasteners being selectively securable to close the open section such that the first complementary fastener and the second complementary fastener are not visible when the fabric steam pocket is mounted onto the steam frame.

2. The fabric steam pocket of claim 1, wherein the shape of the pocket is either rectangular or triangular.

3. The fabric steam pocket of claim 1, wherein the complementary fasteners and layers are arranged so that edges of the open section abut when the first and second complementary fasteners are fastened together.

4. The fabric steam pocket of claim 1, wherein the first and second complementary fasteners include strips of hook and loop fastening fabric.

5. The fabric steam pocket of claim 1, further including an opening in each layer adjacent the open section for receipt of a connector from a steam frame.

6. The fabric steam pocket of claim 1, in combination with a steam frame of a steam appliance.

7. The fabric steam pocket and steam frame combination of claim 6, wherein the steam frame includes a connector for connecting to the main body of a steam appliance, and a steam manifold for conducting steam from the main body into and about the steam frame.

8. The fabric steam pocket and steam frame combination of claim 7, further including a plurality of spaced baffles extending transverse to the steam manifold.

9. The fabric steam pocket and steam frame combination of claim 6 included within a steam mop appliance.

10. A steam frame comprising:

(a) a body portion; and (b) a fabric steam pocket configured to be received by the body portion, the fabric steam pocket having:

(i) first and second layers of steam-permeable fabric of the shape of the steam frame, each layer formed of an outer terry material, an inner mesh material and an intermediate terry material, and quilted with stitching on a fabric surface at a 45 degree angle, the layers being joined at their peripheral edges forming a substantially non-porous pocket with an open section for mounting onto the steam frame;

(ii) a first fastener along an edge of the open section of the first layer, the first fastener being secured to an inside face of the first layer; and (iii) a second fastener along an edge of the open section of the second layer, the second fastener being secured to an inside face of the second layer and extending beyond the edge of the open section, the two fasteners being selectively securable to close the open section such that the two fasteners are not visible when the fabric steam pocket is mounted onto the steam frame.

11. The steam frame of claim 10, wherein the shapes of the fabric steam pocket and the steam frame are rectangular.

12. The steam frame of claim 10, wherein the shapes of the fabric steam pocket and the steam frame are triangular.

13. The steam frame of claim 10, wherein the two fasteners and the two layers are arranged so that edges of the open section abut when the two fasteners are fastened together.

14. The steam frame of claim 10, wherein the two fasteners each include strips of hook and loop fastening fabric.

15. A steam mop comprising:

(a) a steam frame;

(b) a connector for coupling the steam frame to the steam mop; and (c) a fabric steam pocket configured to be received by the steam frame, the fabric steam pocket having:

(i) first and second layers of steam-permeable fabric of the shape of the steam frame, each layer formed of an outer terry material, an inner mesh material and an intermediate terry material, and quilted with stitching on a fabric surface at a 45 degree angle, the layers being joined at their peripheral edges forming a substantially non-porous pocket with an open section for mounting onto the steam frame;

(ii) a first fastener along an edge of the open section of the first layer, the first fastener being secured to an inside face of the first layer; and (iii) a second fastener along an edge of the open section of the second layer, the second fastener being secured to an inside face of the second layer and extending beyond the edge of the open section, the two fasteners being selectively securable to close the open section such that the two fastener are not visible when the fabric steam pocket is mounted onto the steam frame.

16. The steam mop of claim 15, wherein the shapes of the fabric steam pocket and the steam frame are rectangular.

17. The steam mop of claim 15, wherein the shapes of the fabric steam pocket and the steam frame are triangular.

18. The steam mop of claim 15, further comprising an opening in each layer adjacent the open section for receipt of the connector from the steam frame.

19. The steam mop of claim 15, wherein the two fasteners and the two layers are arranged so that edges of the open section abut when the two fasteners are fastened together.

20. The steam mop of claim 15, wherein the two fasteners each include strips of hook and loop fastening fabric.

* * * * *

UNITED STATES PATENT AND TRADEMARK OFFICE

CERTIFICATE OF CORRECTION

PATENT NO. : 7,996,948 B2
APPLICATION NO. : 12/467057
DATED : August 16, 2011
INVENTOR(S) : Brian F. Kaminer et al.

It is certified that error appears in the above-identified patent and that said Letters Patent is hereby corrected as shown below:

At column 8, claim 15, line 4, “fastener” should be changed to -- fasteners --.

Signed and Sealed this
Twenty-fifth Day of October, 2011

David J. Kappos

David J. Kappos
*Director of the United States Patent and Trademark Office*